US012116748B2

(12) United States Patent
Ellingsen et al.

(10) Patent No.: US 12,116,748 B2
(45) Date of Patent: Oct. 15, 2024

(54) SUBSEA FOUNDATION

(71) Applicant: EQUINOR ENERGY AS, Stavanger (NO)

(72) Inventors: Kjell Einar Ellingsen, Tananger (NO); Jone Stangeland, Sola (NO); Geir Gundersen Fuhr, Sola (NO); Lorents Reinås, Stavanger (NO); Morten Æther, Lillestrøm (NO); Harald Sigurd Nesse, Sandnes (NO); Asle Eide, Sandnes (NO)

(73) Assignee: EQUINOR ENERGY AS, Stavanger (NO)

( * ) Notice: Subject to any disclaimer, the term of this patent is extended or adjusted under 35 U.S.C. 154(b) by 175 days.

(21) Appl. No.: 17/639,775

(22) PCT Filed: Aug. 27, 2020

(86) PCT No.: PCT/NO2020/050217

§ 371 (c)(1),
(2) Date: Mar. 2, 2022

(87) PCT Pub. No.: WO2021/040533

PCT Pub. Date: Mar. 4, 2021

(65) Prior Publication Data

US 2022/0333334 A1 Oct. 20, 2022

(30) Foreign Application Priority Data

Aug. 27, 2019 (GB) ..... 1912265

(51) Int. Cl.

| | |
|---|---|
| ***E02D 27/52*** | (2006.01) |
| *E02D 7/20* | (2006.01) |
| *E21B 41/10* | (2006.01) |

(52) U.S. Cl.

CPC ..... *E02D 27/525* (2013.01); *E02D 7/20* (2013.01); *E02D 2250/0053* (2013.01); *E02D 2600/20* (2013.01); *E21B 41/10* (2013.01)

(58) Field of Classification Search

CPC ..... E02D 27/50; E02D 27/525; E02D 7/20; E02D 2250/0053; E02D 2600/20; E21B 41/10

See application file for complete search history.

(56) References Cited

U.S. PATENT DOCUMENTS 2,082,773 A * 6/1937 Adams ..... E02D 27/52 405/222
4,830,541 A * 5/1989 Shatto ..... E21B 41/08 405/226

(Continued)

FOREIGN PATENT DOCUMENTS

| | | |
|---|---|---|
| KR | 10-2015-0049172 | 5/2015 |
| WO | 2017/091085 | 6/2017 |
| WO | 2017/179992 | 10/2017 |

OTHER PUBLICATIONS

International Search Report issued Nov. 25, 2020 in International Application No. PCT/NO2020/050217.

(Continued)

*Primary Examiner* — Benjamin F Fiorello
(74) *Attorney, Agent, or Firm* — Wenderoth, Lind & Ponack, L.L.P.

(57) ABSTRACT

A subsea foundation system and a method of connecting a lower pipe portion to a subsea foundation are provided. The method includes: providing the subsea foundation, an upper pipe portion being connected to the subsea foundation, deploying the subsea foundation subsea; and connecting the lower pipe portion to the upper pipe portion. The subsea foundation system includes: the subsea foundation; the upper pipe portion connected to the subsea foundation, and (Continued)

the lower pipe portion. The lower pipe portion can be connected to the upper pipe portion subsea. The lower pipe portion may be connected to the subsea foundation in a stowed position before deployment subsea. The lower pipe portion may be connected to a pull-in arrangement before deployment subsea.

13 Claims, 6 Drawing Sheets

(56) References Cited

U.S. PATENT DOCUMENTS 6,659,182 B1 * 12/2003 Saugier ..... E21B 19/002 175/10
10,221,539 B2 3/2019 Mathis et al.
2008/0226398 A1 * 9/2008 Gibberd ..... E02D 5/40 405/223
2012/0003048 A1 * 1/2012 Hosoy ..... E21B 33/043 405/172
2016/0047107 A1 * 2/2016 Shin ..... E02D 27/425 405/227
2018/0347140 A1 12/2018 Mathis et al.
2018/0355699 A1 * 12/2018 Mathis ..... E02D 27/525

OTHER PUBLICATIONS

Written Opinion of the International Searching Authority issued Nov. 25, 2020 in International Application No. PCT/NO2020/050217.
Extended European Search Report issued Aug. 14, 2023 in corresponding European Patent Application No. 20855928.6.

* cited by examiner

SUBSEA FOUNDATION

BACKGROUND OF THE INVENTION

1. Field of the Invention

The invention relates to a subsea foundation system and a method of connecting a lower pipe portion to a subsea foundation.

2. Description of the Related Art

Many subsea devices, such as a well and wellhead equipment, require a foundation on which they can be located during use. For example, a subsea well assembly will generally comprise a foundation. The foundation is used to support the subsea well which extends into the seabed and the wellhead equipment such as a blowout preventer. A known type of subsea foundation is the suction anchor. A suction anchor used as a subsea foundation comprises a skirt. The suction anchor is lowered onto the seabed and then sucked into the seabed by reducing the pressure inside the skirt. Once the suction anchor has been sucked into the seabed, the suction anchor may provide a foundation for a well or another subsea device.

It has been found that in certain circumstances it may be beneficial if the subsea foundation further comprises an inner member in the form of a pipe. It has been found that it is beneficial for the subsea foundation to have a shorter pipe during transportation and before deployment subsea but a longer pipe before the subsea foundation is landed on the seabed.

It is known from WO2017/179992 to provide a subsea foundation comprising a suction anchor with a two part inner member. In this case the lower part of that member protrudes from the suction skirt of the suction anchor and is attached to the suction anchor at the installation site. This is achieved by first placing the lower part on the seabed, then deploying the suction anchor subsea, next connecting a pull-in line between the lower part and the machine anchor, and then connecting the lower part to the upper part subsea using a pull-in line through the center of the inner member.

However, there is a desire for an alternative, more convenient and/or more reliable method and apparatus for connecting a lower part of a two part inner member or pipe to the subsea foundation at the installation site.

SUMMARY OF THE INVENTION

In a broad aspect the present invention provides a method of connecting a lower pipe portion to a subsea foundation, the method comprising: providing the subsea foundation, wherein the subsea foundation comprises an upper pipe portion connected to the subsea foundation, deploying the subsea foundation subsea; and connecting the lower pipe portion to the upper pipe portion.

The upper pipe portion may not protrude beyond the bottom of the suction anchor.

The subsea foundation may comprise a suction anchor and the upper pipe portion may be connected to the suction anchor.

In another broad aspect, the present invention provides a subsea foundation system, e.g. for deployment subsea, wherein the subsea foundation system comprises: a subsea foundation; an upper pipe portion connected to the subsea foundation, and a lower pipe portion, wherein the subsea foundation is arranged such that subsea the lower pipe portion can be connected to the upper pipe portion.

The upper pipe portion may not protrude beyond the bottom of the suction anchor.

The subsea foundation may comprise a suction anchor and the upper pipe portion may be connected to the suction anchor.

The lower pipe may be connected to the subsea foundation, e.g. a suction anchor of the foundation) in a stowed position. The subsea foundation may be deployed subsea with the lower pipe portion in the stowed position. The lower pipe portion may be released from the stowed position subsea. Thus the subsea foundation may be arranged such that subsea the lower pipe portion can be released from the stowed position and connected to the upper pipe portion subsea.

In a first aspect, the present invention may provide a method of connecting a lower pipe portion to a subsea foundation, the method comprising: providing the subsea foundation, wherein the subsea foundation comprises an upper pipe portion connected to the subsea foundation, e.g. a suction anchor of the subsea foundation, connecting the lower pipe portion to the subsea foundation, e.g. suction anchor, in a stowed position; deploying the subsea foundation subsea with the lower pipe portion in the stowed position; releasing the lower pipe portion from the stowed position subsea; and connecting the lower pipe portion to the upper pipe portion.

In a second aspect the present invention may provide a subsea foundation system for deployment subsea, wherein the subsea foundation system comprises: a subsea foundation, e.g. a subsea foundation comprising a suction anchor; an upper pipe portion connected to the subsea foundation, e.g. the suction anchor; and a lower pipe portion connected to the subsea foundation, e.g. the suction anchor, in a stowed position, wherein the subsea foundation system is arranged such that subsea the lower pipe portion can be released from the stowed position and connected to the upper pipe portion.

By connecting the lower pipe portion to the subsea foundation, e.g. a suction anchor of the foundation, in a stowed position and then deploying the subsea foundation subsea with the lower pipe portion in the stowed position, both the subsea foundation and the lower pipe portion may be conveniently deployed to the desired position where the lower pipe portion will/can be connected to the upper pipe portion. This may facilitate connecting the lower pipe portion to the subsea foundation. This is because the location of the lower pipe portion will be known and only one deployment operation has to be performed for the two components.

The desired position may be any position in the water column where the water conditions are sufficiently stable that they will not interfere with connecting of the lower pipe portion to the upper pipe portion. The water conditions are generally sufficiently stable that the lower pipe portion can be connected to the upper pipe portion at a depth or position where the water is not influenced by waves on the surface of the water. In some climatic conditions, there is a little disturbance of the water by waves and, in such circumstances, the depth or position where the water is not influenced by waves is closer to the surface of the water than is generally the case.

Additionally or alternatively the lower pipe portion may be connected to a pull-in arrangement and then deployed subsea with the lower pipe portion connected to the pull-in arrangement. The pull-in arrangement may be used to connect the lower pipe portion to the upper pipe portion. The lower pipe portion may be connected to a pull-in arrangement and the subsea foundation may be arranged such that the subsea lower pipe portion can be connected to the upper pipe portion using the pull-in arrangement.

In a third aspect, the present invention may provide a method of connecting a lower pipe portion to a subsea foundation, the method comprising: providing a subsea foundation (optionally comprising a suction anchor) comprising an upper pipe portion connected to the foundation, e.g. the suction anchor, connecting the lower pipe portion to a pull-in arrangement; deploying the subsea foundation subsea with the lower pipe portion connected to the pull-in arrangement; and connecting the lower pipe portion to the upper pipe portion subsea using the pull-in arrangement. The method may further comprise connecting the lower pipe portion to the subsea foundation in a stowed position before or after connecting the lower pipe portion to the pull-in arrangement.

In a fourth aspect the present invention may provide a subsea foundation system for deployment subsea, wherein the subsea foundation comprises: a subsea foundation (e.g. comprising a suction anchor); an upper pipe portion connected to the subsea foundation, e.g. suction anchor; and a lower pipe portion connected to a pull-in arrangement, wherein the subsea foundation system is arranged such that subsea the lower pipe portion can be connected to the upper pipe portion using the pull-in arrangement.

By connecting the lower pipe portion to a pull-in arrangement before the subsea foundation is deployed subsea, the lower pipe portion may be conveniently attached to the upper pipe portion without having to connect the pull-in arrangement to the lower pipe portion subsea when connection may be more difficult. In particular, connecting the lower pipe portion to a pull-in arrangement before the subsea anchor is deployed subsea has the benefit that the connection of the pull-in in arrangement to one or both of the lower pipe portion and the subsea foundation can be done manually (optionally will the use of appropriate mechanical devices such as a crane) rather than using one or more remote operating vehicles. This results in cost and time savings.

Additionally or alternatively a pipe overlap section is provided. The pipe overlap section may be arranged to overlap a portion of the upper pipe section and/or the lower pipe section when the lower pipe portion is connected (directly or indirectly) to the upper pipe section. The method may comprise providing the upper and lower pipe portion and the pipe overlap section. The method may comprise connecting the lower pipe section to the upper pipe section such that the pipe overlap section overlaps a portion of the upper pipe and/or the lower pipe portion In a fifth aspect the present invention provides a subsea foundation system, wherein the subsea foundation system comprises: a subsea foundation (optionally comprising a suction anchor); an upper pipe portion connected to the subsea foundation, e.g. the suction anchor; a lower pipe portion; and a pipe overlap section, wherein the pipe overlap section is arranged to overlap a portion of the upper pipe portion and/or the lower pipe portion when the lower pipe portion is connected to the upper pipe portion.

In a sixth aspect the present invention provides a method of connecting a lower pipe portion to a subsea foundation, the method comprising: providing the subsea foundation (optionally comprising a suction anchor) comprising an upper pipe portion connected to the subsea foundation, e.g. the suction anchor; providing a lower pipe portion and a pipe overlap section; and connecting the lower pipe portion to the upper pipe portion such that the pipe overlap section overlaps a portion of the upper pipe portion and/or the lower pipe portion.

By providing a pipe overlap portion the lower pipe portion may be reliably connected to the upper pipe portion.

The features of each of the first to sixth aspects may be applicable to any of the other of the first to sixth aspects. In other words, whilst the features of each of these aspects may be independent, they may also be used in combination.

Thus, when in combination for example, the present invention may provide a method of connecting a lower pipe portion to a subsea foundation, the method comprising: providing the subsea foundation, wherein the subsea foundation comprises (optionally a suction anchor and) an upper pipe portion connected to the subsea foundation, e.g. the suction anchor, providing the lower pipe portion and a pipe overlap section; connecting the lower pipe portion to a pull-in arrangement; connecting the lower pipe portion to the subsea foundation, e.g. the suction anchor in a stowed position; deploying the subsea foundation subsea with the lower pipe portion in the stowed position and connected to the pull-in arrangement; releasing the lower pipe portion from the stowed position subsea; and connecting the lower pipe portion to the upper pipe portion using the pull in arrangement such that the pipe overlap section overlaps a portion of the upper pipe portion and/or the lower pipe portion.

The present invention may provide a subsea foundation system for deployment subsea, wherein the subsea foundation system comprises: a subsea foundation, e.g. comprising a suction anchor; an upper pipe portion connected to the subsea foundation, e.g. suction anchor; a lower pipe portion connected to the subsea foundation, e.g. suction anchor, in a stowed position and connected to a pull-in arrangement; and a pipe overlap section, wherein the subsea foundation system is arranged such that subsea the lower pipe portion can be released from the stowed position and connected to the upper pipe portion using the pull-in arrangement, wherein the pipe overlap section is arranged to overlap a portion of the upper pipe portion and/or the lower pipe portion when the lower pipe portion is connected to the upper pipe portion.

The following optional features are applicable to any of the above aspects.

The upper pipe portion may not protrude beyond the bottom of the subsea foundation, e.g. beyond the bottom of the suction anchor. This may make transportation of the subsea foundation, e.g. suction anchor, easier.

When the lower pipe portion is connected to the upper pipe portion, at least part of the lower pipe portion may protrude beyond (i.e. extend beyond) the bottom of the subsea foundation, e.g. suction anchor. This means that when the subsea foundation is lowered towards the seabed the lower pipe portion may contact and penetrate the seabed before the subsea foundation, e.g. before the suction skirt of a suction anchor, if present. This may facilitate the installation of the subsea foundation on the seabed. For example, in the case that the foundation comprises a suction anchor, this may help ensure that the suction anchor is at the correct orientation before the suction skirt of the suction anchor contacts the seabed.

The lower pipe portion may be connected to the upper pipe portion when the subsea foundation, e.g. suction anchor, is subsea but before it reaches the seabed. For example, the subsea foundation may be suspended above the seabed whilst the lower pipe portion is connected to the upper pipe portion.

The lower pipe portion may be directly connected to the upper pipe portion. For example, an upper end of the lower pipe portion may directly abut the lower end of the upper pipe portion. Alternatively, the lower pipe portion may be indirectly connected to the upper pipe portion, such as via the pipe overlap portion. When the lower pipe portion is connected to the upper pipe portion the internal bores of the pipe portions may be connected in fluid communication.

The upper pipe portion and lower pipe portion may have at least substantially the same inner and/or outer diameter.

The lower pipe portion may be in the stowed position during transportation of the subsea foundation, e.g. suction anchor, to the installation site. Thus the method may comprise transporting the subsea foundation to the subsea deployment site with the lower pipe portion in the stowed position. For example, the lower pipe portion may be put into in the stowed position onshore or when the subsea foundation is on a vessel for transportation, i.e. before the subsea foundation is deployed subsea.

When the lower pipe portion is in the stowed position, the lower pipe portion may not protrude beyond the bottom of the subsea foundation, e.g. beyond the bottom of the suction anchor. This may avoid the lower pipe being in the way during transportation of the subsea foundation.

The stowed position may be a position in which the lower pipe portion is attached to the outside of the subsea foundation, e.g. to the outside of the suction skirt of the suction anchor. The lower pipe portion may be shorter than the subsea foundation, e.g. shorter than the suction skirt of the suction anchor. As a result, when connected to the subsea foundation, e.g. the suction skirt, the lower pipe portion may not protrude beyond the top or the bottom of the subsea foundation, e.g. suction anchor.

Alternatively, the lower pipe portion may be longer than the subsea foundation, e.g. longer than the suction skirt of the suction anchor. In this case the lower pipe may be connected to the subsea foundation, e.g. the suction skirt, such that the lower pipe portion does not protrude beyond the bottom of the subsea foundation but does protrude beyond the top of the subsea foundation, e.g. beyond the top of the suction anchor.

The subsea foundation, e.g. suction anchor, may comprise one or more lugs (i.e. projections) for supporting the lower pipe portion when it is in the stowed position. The lug(s) may be provided on the outside of the subsea foundation, e.g. on the outside of the suction skirt of the suction anchor. The one or more of the lugs may support the lower pipe portion in a vertical direction when the bottom of the subsea foundation is horizontal.

The lower pipe portion may be held in the stowed position by one or more straps. The strap(s) may extend around the subsea foundation, e.g. around the suction anchor, and the lower pipe portion. The strap(s) may be jacking strap(s).

The step of releasing the lower pipe portion from the stowed position may comprise releasing the one or more straps. For example, the strap(s) may be released by an ROV. The strap(s) may be released by cutting the straps. The straps may be cut subsea.

Once the straps have been released the lower pipe portion may be allowed to fall or be lowered in a controlled way from the stowed position to a position beneath the subsea foundation, e.g. beneath the suction anchor. If the lower pipe is connected to the subsea foundation, e.g. to the suction anchor, such as via a pull-in arrangement, the connection, e.g. the pull-in arrangement, may hold the lower pipe in a suspended position beneath the subsea foundation and/or beneath the upper pipe portion. The pull-in arrangement may be used to connect the lower pipe portion to the upper pipe portion.

The lower pipe portion may move (e.g. fall under the action of gravity or be lowered in a controlled way through any know method of hoisting such as by the aid of a crane, pulley system, or hydraulic cylinders) from the stowed position to a position below the subsea foundation when subsea. The lower pipe portion may fall from the stowed position in a relatively slow manner compared to if the lower pipe portion were released when the foundation is not in the water. This is due to the resistance of the seawater. Thus the lower pipe portion may fall in a relatively slow and/or controlled manner from the stowed position to a position underneath the suction anchor.

The lower pipe portion when in the stowed position may be inverted compared to its position when it is connected to the upper pipe portion. Thus the lower pipe portion may rotate through 180° as it falls from the stowed position to a position underneath the suction anchor and upper pipe portion.

Once the lower pipe portion has been connected to the upper pipe portion the foundation may be further lowered towards and/or installed on and/or in the seabed.

When connected to a pull-in arrangement, the lower pipe may be directly or indirectly connected to the pull-in arrangement. The lower pipe may be connected to the pull-in arrangement such that the pull-in arrangement can be operated to pull-in the lower pipe portion into connection with the upper pipe portion.

When the foundation comprises a pipe overlap section, the lower pipe portion may be indirectly connected to the pull-in arrangement via the pipe overlap section, e.g. if the pipe overlap section is connected to the lower pipe portion.

When the lower pipe section is connected to the pull-in arrangement and the subsea foundation, e.g. the suction anchor, is ready for deployment, the lower pipe section may not (yet) be connected to the upper pipe portion.

The pull-in arrangement may be connected to the lower pipe portion when the subsea foundation is above the surface of the water. For example, the pull-in arrangement may be connected to the lower pipe portion when the subsea foundation is onshore or on a vessel. This may reduce the number of operations that have to be performed subsea.

The step of connecting the lower pipe portion to the upper pipe portion may comprise pulling the lower pipe portion towards the upper pipe portion using the pull-in arrangement.

The pull-in arrangement may comprise one or more pull-in lines. For example, the pull-in arrangement may comprise two pull-in lines. This may allow reliable and/or even pull-in whilst minimizing the number of components.

The line(s) may each be rope, wire, chain etc. The one or more pull-in lines may each extend parallel, adjacent and/or near (over at least a part of its length) to the upper pipe portion. The one or more pull-in lines may each extend through the subsea foundation, e.g. through the suction anchor.

The one or more pull-in lines may extend through one or more or respective pull-in line conduits. The, or each, pull-in line conduit may extend through the subsea foundation, e.g. through the internal volume of the suction anchor and through a top surface of the internal volume. For example, the pull-in line conduit may extend through the internal volume of the suction anchor and through a top surface of the internal volume. This may allow the pull-in line to extend movably through the internal volume and top surface without affecting the required seal of the internal volume. This is because the pull-in line conduit may be air tightly connected to the top surface of the internal volume and, in use, may seal with the seabed before the pressure is reduced in the internal volume to suck the suction anchor into the seabed.

The pull-in lines may extend through the upper pipe portion. The pull-in lines may extend through the wall of the upper pipe portion. The pull-in lines may extend through the wall of the upper pipe portion at an elevation that is above the foundation, e.g. above the suction anchor, yet is below other components, such as a conductor housing (if present). The may mean that the pull-in lines do not have to pass through the suction volume if the foundation is a suction anchor.

The pull-in line conduit(s), if present, may extend internally or externally of the upper pipe portion.

In use, the pull-in line may be the only component that is inserted into or passed through the pull-in line conduit (other than perhaps seabed as the foundation is sucked into the seabed). The pull-in line conduit(s) may be separate conduits to the upper and lower pipe portions. The pull-in line conduit may not be a conduit through which a subsea well extends.

The, or each, pull-in line conduit may have a diameter that is the same as or slightly larger than the maximum outer diameter of the pull-in line that passes through the pull-in line conduit.

The pull-in line conduit may help protect the pull-in line as the foundation is landed on the seabed, e.g. as the suction anchor is being sucked into the seabed.

The, or each, pull-in line conduit may have connectors connecting it to internal stiffeners in the foundation and/or the upper pipe portion. The pull-in line conduit connectors may have a relatively small width dimension (compared to its height and length), this is to minimize the resistance that the pull-in line conduit connectors may cause when fixing the foundation on the seabed, e.g. sucking the suction anchor into the seabed.

The subsea foundation may comprise a pull-in line grip for each pull-in line. The, or each, pull-in line grip may be located on top of the subsea foundation. For example on top of/above the suction anchor. The pull-in line grip may be located above the internal suction volume of the suction anchor (if a suction anchor is present). The pull-in line grip(s) may be located at the same height as the top of a conductor housing (if present).

If the foundation comprises I-beams that support the wellhead, e.g. on the top plate of the suction anchor, the pull-in line(s) may pass through the foundation, e.g. out of the internal volume, between two I-beams. The pull-in line grip(s) may be located at the same height as, or above, the top of the I-beams (if present). This is so that the grip and top of the pull-in line may be easily accessible and unobstructed by the presence of the I-beams.

The pull-in arrangement, e.g. the pull-in line(s), may be positioned so that it can be operated whilst the subsea foundation is suspended by a lifting arrangement, e.g. lifting wires. For example, the pull-in line(s) may be located so that they can be pulled through the subsea foundation whilst the foundation is suspended subsea.

The pull-in wires may be radially outward of, but relatively close to, the upper pipe portion.

The pull-in line grip(s) may comprise a one way mechanism, e.g. a ratchet, that permits the pull-in line to be pulled through the foundation towards the top of the foundation, e.g. towards the top of the suction anchor, but that, at least in one mode of operation, prevents movement of the pull-in line in the opposite direction, i.e. back into the foundation/suction anchor. The, or each, pull-in line may be pulled through a respective pull-in line grip in a first direction and the pull-in line grip may act to prevent the respective pull-in line moving in a second opposite direction. The first direction may be an upwards direction, e.g. through and out of the internal volume of the suction anchor, and cause the lower pipe portion to move towards the upper pipe portion, the second direction may be a downwards direction, e.g. into of the internal volume of the suction anchor and may cause the lower pipe portion to move away from the upper pipe portion.

A pulling mechanism, such as a crane, winch, ROV or buoyancy element etc., may be used to pull the pull-in line through the subsea foundation (e.g. in a direction towards the top of the suction anchor) so as to pull the lower pipe portion towards and then perhaps into connection with the upper pipe portion.

The pull-in line grip(s) may comprise a lock. This may be used to lock the pull-in line in a certain position.

To connect the lower pipe portion to the upper pipe portion, the pull-in line(s) may be pulled through the subsea foundation, e.g. using a pull-in mechanism, to pull the lower pipe portion towards the upper pipe portion. The pull-in line may be pulled through the pull-in line conduit and/or the pull-in line grip. When the force on the pull-in line is released, the pull-in line grip may act to prevent the pull-in line moving back in the opposite direction.

The pull-in line grip may have a release mechanism. This may allow the pull-in line to be released when desired, e.g. during retrieval of the subsea foundation.

The lower pipe portion may comprise and/or be connected to pull-in line connection point(s). There may be a pull-in line connection point for each pull-in line. These may for example on pull-in line connection wing(s). The pull-in line connection wing(s) may extend radially outward from the lower pipe portion. This is so that the pull-in line(s) may be radially spaced from the lower pipe portion. This radial spacing may aid aligning the lower pipe portion with the upper pipe portion for connection.

When the lower pipe portion is connected to the upper pipe portion, the pull-in line connection point(s) may be aligned with, e.g. underneath, a respective pull-in line grip. This is so that the pull-in line can extend directly upwards from the pull-in line connection point, through the pull-in line conduit to the pull-in line grip.

Connecting the lower pipe portion to the pull-in arrangement may comprise attaching one or more pull-in lines to the lower pipe portion and to the subsea foundation, e.g. to the suction anchor. The pull-in lines may be sufficiently long such that the lower pipe portion can be put into the stowed position when the pull-in lines are connected between the lower pipe portion and the subsea foundation. The pull-in lines may be slack when the lower pipe portion is in the stowed position and/or before the pull-in lines are pulled up through the subsea foundation. When the lower pipe portion is released from the stowed position, the pull-in lines may act to hold the lower pipe portion in a suspended position below the upper pipe portion. The pull-in lines may then be pulled in to cause the lower pipe portion to be connected to the upper pipe portion.

By connecting the lower pipe portion to the pull-in line(s) before deployment subsea operations may be minimized. Thus, when subsea, there may be no need to connect the pull-in arrangement to the subsea foundation and/or lower pipe portion. Connecting the lower pipe portion to the upper pipe portion may be achieved by pulling the pull-in lines through the subsea foundation.

The pipe overlap section (if present) may overlap the upper pipe portion and the lower pipe portion.

The overlap section may be long enough to provide sufficient alignment between the upper and lower pipe portions without needing a narrow clearance over too long a distance which may hamper the subsea mating of the two parts. For example, the pipe overlap section may overlap the upper pipe portion and/or the lower pipe portion by about 1 m.

When the lower pipe portion is connected to the upper pipe portion, the upper pipe portion and/or the lower pipe portion may be received within at least a portion of the pipe overlap portion.

The pipe overlap section may have an inner diameter that is equal to the outer diameter of the upper pipe portion and/or the lower pipe portion.

The inner diameter of the lower pipe portion may the same as the inner diameter of the upper pipe portion. The outer diameter of the lower pipe portion may the same as the outer diameter of the upper pipe portion.

When the lower pipe portion and/or the upper pipe portion is received within the pipe overlap section the pipe overlap section may be coaxial with the lower pipe portion and/or the upper pipe portion.

The pipe overlap section may ensure that there is a connection between the upper and lower pipe portion in a lateral direction. For example, the pipe overlap portion may allow the connection to withstand lateral forces. A simple end to end connection of the upper and lower pipe portions without an overlap section may be liable to disengage whilst the lower pipe portion is being sunk into the seabed, .e.g. if the lower pipe portion hits an obstruction, such as a rock, on one side.

The pipe overlap section may be connected to and/or integral with the upper pipe portion or the lower pipe portion. The pipe overlap section may be connected to the upper pipe portion or the lower pipe portion before deployment of the foundation subsea.

The pipe overlap section may be welded to the upper pipe portion or the lower pipe portion. This welding may be performed before the foundation is deployed subsea. The pipe overlap section may also overlap the pipe portion it is welded to.

When the pipe overlap section is connected to the lower pipe portion, the pipe overlap section and lower pipe portion may together form a pipe extension.

When connecting the upper pipe portion to the lower pipe portion, the method may comprise receiving the upper pipe portion and/or the lower pipe portion within the pipe overlap section. The upper pipe portion and/or the lower pipe portion may be received within the pipe overlap section until it abuts the other of the lower pipe portion and/or the upper pipe portion. Thus the abutting of the lower pipe portion and the upper pipe portion may act as a stop to prevent the upper pipe portion or the lower pipe portion being received any further into the pipe overlap section.

The pipe overlap section may be put into the stowed position with the lower pipe portion.

When the pipe overlap section is connected to the lower pipe portion, the pull-in arrangement may be connected to the lower pipe portion via the pipe overlap section. Thus, the pull-in arrangement, e.g. pull-in lines and/or pull-in line connection wings, may be connected to the pipe overlap section.

The pipe overlap section may be shaped, e.g. sufficiently short, such that when the upper pipe portion and lower pipe portion are connected, the pipe overlap section is not obstructed by other components of the foundation, such as stiffening plates (if present). The stiffening plates may be plates that, if the foundation comprises a suction anchor, radially extend between the outer suction skirt and the inner pipe of the suction anchor.

The foundation may comprise a pipe connection guide for guiding the connection between the upper pipe portion and lower pipe portion. The pipe connection guide may be fixed (directly or indirectly, such as via the pipe overlap section) to (e.g. an end of) the upper pipe portion and/or the lower pipe portion. For example, when the pipe overlap section is fixed to the lower pipe portion, the pipe connection guide may be located at a top end of the pipe overlap section which receives the upper pipe portion.

The pipe connection guide may comprise a guide funnel. The guide funnel may be circumferentially discontinuous. This is so that the guide funnel does not interfere with other components of the foundation, such as stiffening plates (if present). When the guide funnel is circumferentially discontinuous, e.g. made up of obliquely angled guide pieces, parts of the foundation, e.g. stiffening plates, may be located between the discontinuous pieces, when the lower pipe portion is connected to the upper pipe portion.

The connection guide may thus comprise one or more obliquely angled guide pieces.

The connection guide may have a wider diameter at its entrance that may facilitate connecting the lower pipe portion to the upper pipe portion. For example, when the connection guide is provided on the pipe overlap section, the connection guide may help guide the upper pipe portion or the lower pipe portion into the pipe overlap section.

When the lower pipe portion is connected to the upper pipe portion, these may be held together using the pull-in arrangement and/or a friction fit between the overlap portion and the lower pipe portion and/or the upper pipe portion. There may be no other fixing device holding the upper pipe portion and the lower pipe portion together. This is because, such connection may not be necessary. This is because the action of putting the foundation into the seabed may act to keep the upper pipe portion and the lower pipe portion connected together. However, the compression forces between the upper pipe portion, lower pipe portion and pipe overlap section may mean that it is required for there to be an effective stop between the upper and lower pipe portions. This may be provided by the upper and lower pipe portions being of equal diameter.

Not having a fixing device/means between the upper pipe portion and the lower pipe portion may make retrieval of the suction anchor easier.

Alternatively, there may be a fixing device that fixes the lower pipe portion to the upper pipe portion when they are connected. For example, the upper and lower pipe portion may be fixed together with a snap ring (e.g. in an overlapping section). The upper and lower pipe portion may be fixed together using any sort of connection such as a threaded connection or a quick lock connection.

The system may comprise an internal, releasable and reusable fixing tool. The tool may be arranged so that in use it can hold onto the lower section as it is pulled up and then snapped in place. The snap ring may be made to hold a certain weight. The snap ring may be released on retrieval of the foundation.

The foundation may be arranged so that, if the suction anchor is retrieved from the seabed, the lower pipe portion is not retrieved. This may be facilitated if there is no fixing device/means between the upper pipe portion and the lower pipe portion or, if a fixing device is present, if it has a release mechanism.

If it is desired to retrieve the suction anchor, the retrieval method may comprise disconnecting the pull-in arrangement from the subsea foundation. This may be achieved by releasing the pull-in line grip(s) and/or cutting the pull-in line(s) (e.g. with cutting pliers). The method may comprise forcing the foundation out of the seabed, e.g. by pumping fluid into the internal volume of the suction anchor to force the suction anchor out of the seabed, whilst leaving the lower pipe portion, and optionally the pipe overlap section, if present, behind.

The suction anchor, upper pipe portion, lower pipe portion and pipe overlap section (if present) together may form at least part of a subsea foundation system.

The subsea foundation may be a foundation for a subsea well. Thus the subsea foundation may be a subsea well foundation. The well may be an oil and/or gas well.

The upper pipe portion and lower pipe portion when connected together may provide a pipe for a well, e.g. a conductor.

When the foundation comprises a suction anchor, the upper pipe may extend through the suction anchor within the suction skirt. The upper pipe (and lower pipe when connected to the upper pipe) may for example provide at least part of a central pipe of a suction anchor.

The present invention may provide, a subsea well foundation, the foundation comprising: a suction anchor, the suction anchor comprising an inner pipe for a well and an outer suction skirt located around/about the inner pipe, wherein the inner pipe comprises the upper pipe portion and the lower pipe portion.

Alternatively the upper pipe may be connected to and/or extend outside of the foundation, e.g. outside of the suction skirt of the suction anchor. Even in this case the upper pipe may not protrude beyond the bottom of the foundation.

Deployment of the subsea foundation subsea may mean that the subsea foundation is moved from a location above the water to a location within the body of water.

The subsea foundation being for deployment subsea may mean that it is suitable for deploying subsea and hence has not yet been deployed subsea. Thus, it is in a state that has not yet been deployed subsea.

The term 'subsea foundation' does not mean that the foundation is necessarily subsea, but rather that in use it will be subsea, i.e. it is to be used subsea.

Whilst the terms subsea and seabed etc. are used herein, it should be appreciated that this means under any large body of water such an ocean, lake, etc. and on any corresponding waterbed/bed beneath that body of water.

BRIEF DESCRIPTION OF THE DRAWINGS

Certain preferred embodiments of the present invention will now be described by way of example only with reference to the accompanying drawings, in which.

DETAILED DESCRIPTION OF THE INVENTION

Figure 1:
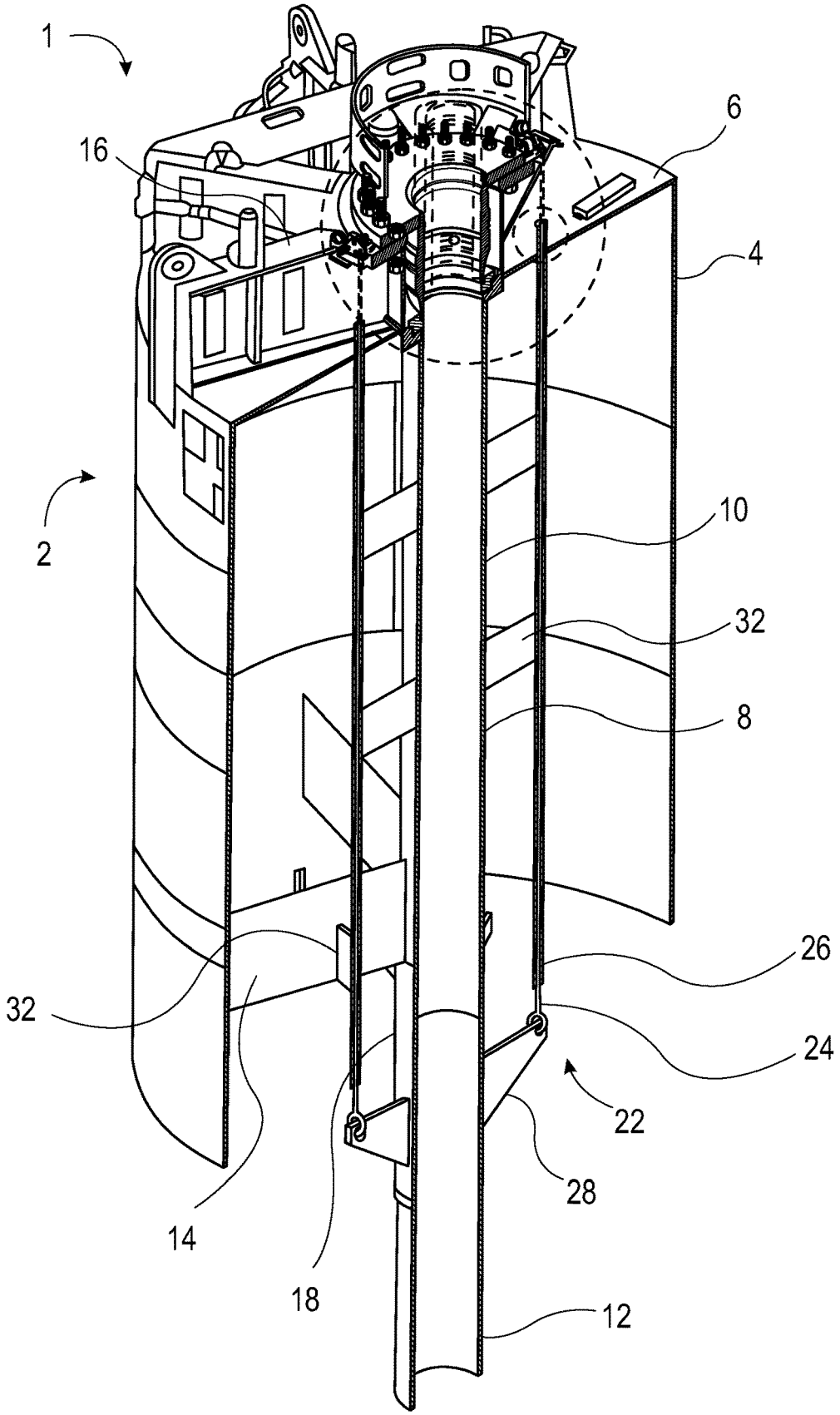
FIG. 1 shows a subsea foundation comprising a suction anchor.

FIG. 1 shows a subsea foundation 1 comprising a suction anchor 2. The suction anchor 2 comprises an outer suction skirt 4, a top plate 6 and a center pipe 8 that together bound an internal suction volume. The center pipe 8 is connected indirectly in an airtight manner to the top plate 6.

Whilst the present invention is described herein in relation to a subsea foundation comprising a suction anchor, it should be appreciated that the invention may be applicable to other types of subsea foundations that may not comprise a suction anchor.

The center pipe 8 comprises an upper pipe portion 10 and a lower pipe portion 12. The lower pipe portion 12 is connectable and disconnectable from the upper pipe portion 10. The upper pipe portion 10 does not protrude beyond the bottom of the suction skirt 4 of the suction anchor 2. The lower pipe portion 12 however does protrude beyond the bottom of the suction anchor 2. Thus, when the subsea foundation 1 is sunk into the seabed the lower pipe portion 12 will reach and penetrate the seabed first. This may facilitate installation as a part (the lower pipe portion 12) can be penetrated into the seabed so as to hold the foundation 1 in an approximate location relative to the seabed whilst the orientation of the suction anchor 2 can be assessed and adjusted, if required.

The center pipe 8 is fixed to the suction anchor 2 at an upper end to the top plate 6 and supported and centralized at the bottom end by stiffening plates 14.

The suction anchor 2 comprises I-beams 16 (four can be seen in FIG. 1) on the top plate 6. These I-beams 16 act to strengthen the top plate 6 and support the wellhead (shown in phantom).

The connection between the upper pipe portion 10 and the lower pipe portion 12 is overlapped by a pipe overlap section 18.

Figure 3:
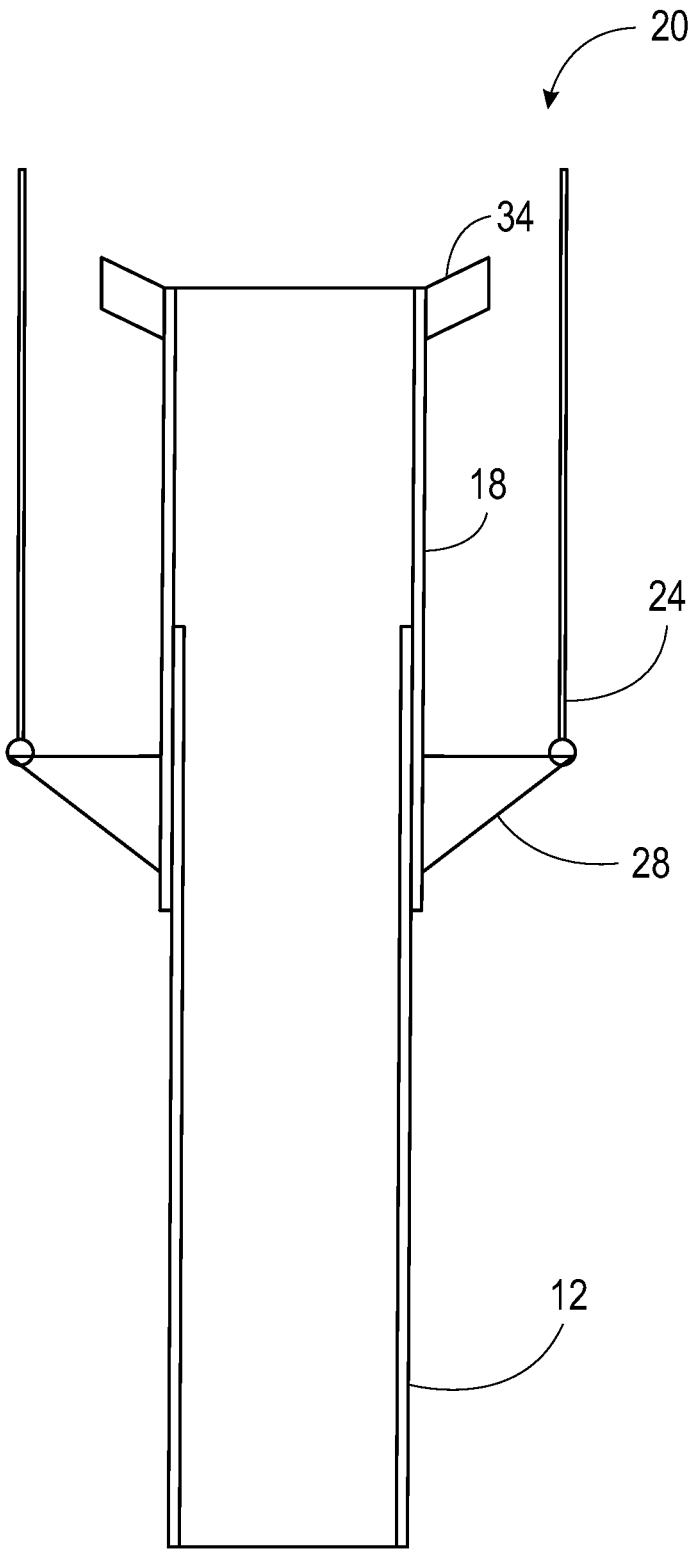
FIG. 3 is a cross section of a pipe extension.

The pipe overlap section 18 may be fixed, such as welded, to the lower pipe portion 12 which together may form a pipe extension 20 as shown in FIG. 3.

The pipe overlap section 18 partially overlaps the lower pipe portion 12 so that a reliable connection can be made between the lower pipe portion 12 and the pipe overlap section 18.

The pipe overlap section 18 and hence the lower pipe portion 12 are connected to a pull-in arrangement 22. The pull-in arrangement 22 is used to connect the lower pipe portion 12 to the upper pipe portion 10.

The pull-in arrangement 22 comprises two pull-in lines 24 that extend through the suction anchor 2 through pull-in conduits 26. The pull-in conduits 26 at their upper end are connected to (and pass through) the suction anchor top plate 6 in a sealing manner. These conduits 26 allow the pull-in lines 24 to pass through the suction anchor internal volume without compromising the sealed nature of the internal volume. The pull-in lines 24 and pull-in line conduits 26 pass through the top plate 6 between two of the I-beams 16.

Figure 2:
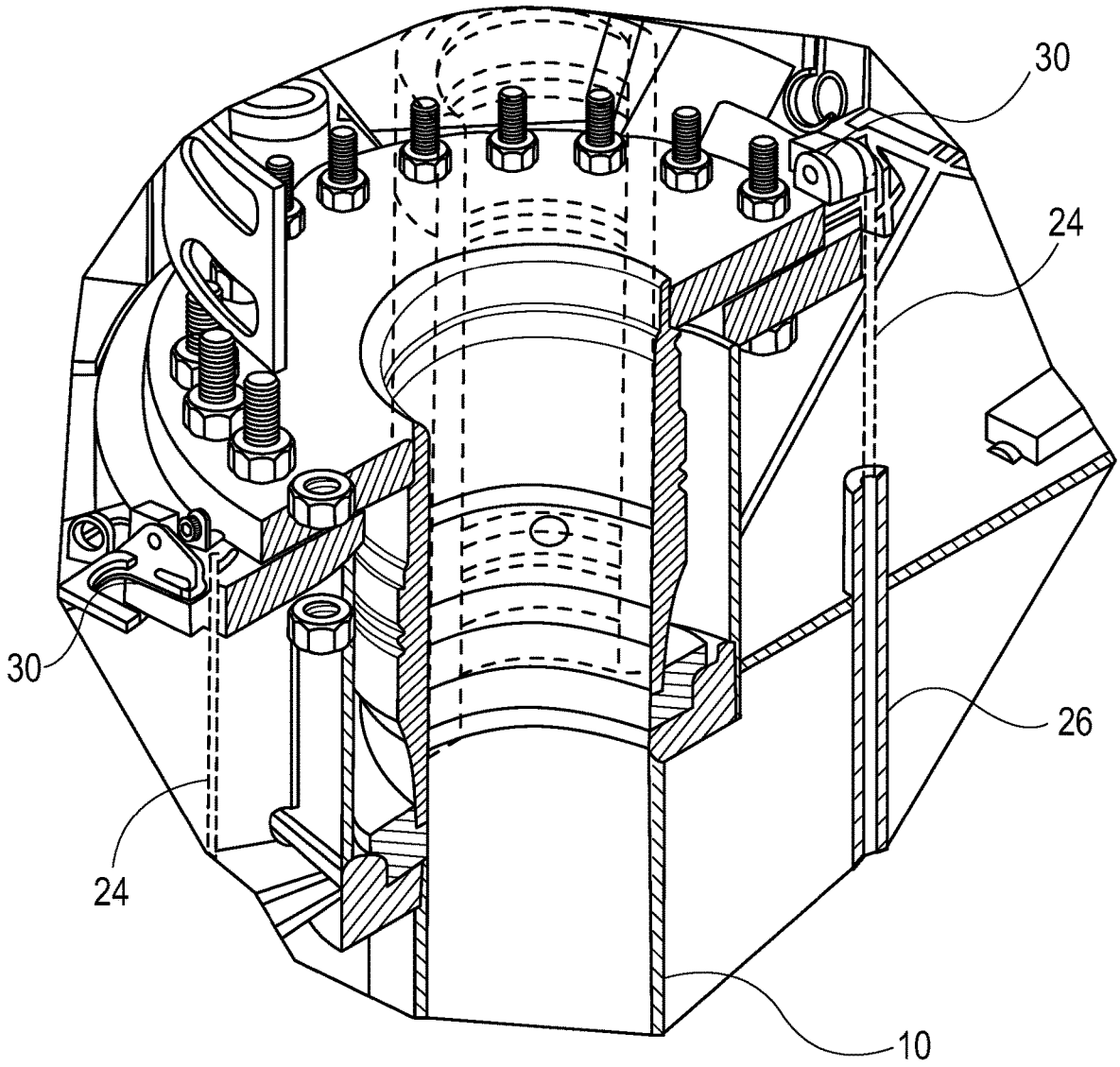
FIG. 2 is an enlargement of Detail 1 of FIG. 1.

The pipe overlap section 18 is connected to pull-in line connection wings 28. The pull-in lines 24 each extend between a pull-in line connection wing 28 at one end to a pull-in line grip 30 at the other end. The pull-in line grips 30 are shown most clearly in FIG. 2. These pull-in line grips 30 each grip a pull-in line 24 and allow it to be pulled through and out of the suction anchor only. To achieve this the grips 30 each comprise a one-way mechanism such as a ratchet and a lock to hold the pull-in line 24 once it has been pulled through the grip 30.

The pull-in line connection wings 28 allow the pull-in lines 24 to be radially spaced from the center pipe 8.

The pull-in line conduits 26 are held in a fixed position relative to the center pipe 8 by pull-in line conduit connectors 32. These connectors 32 connect the pull-in line conduits 26 to the center pipe 8 and the internal stiffeners 14.

At the top end of the pipe overlap section 18 is a pipe connection guide 34. This guide 34 is made up of a number of obliquely angled guide pieces that forms a circumferentially discontinuous guide funnel. When the lower pipe portion 12 is connected to the upper pipe portion 10 and the pipe overlap section 18 is overlapped over the upper pipe portion 10 the pipe connection guide 34 is used to guide the upper pipe portion 10 into the pipe overlap section 18.

The pipe connection guide 34 is circumferentially discontinuous so that it can be located between the internal stiffeners 14 as shown in FIG. 1.

Figure 4:
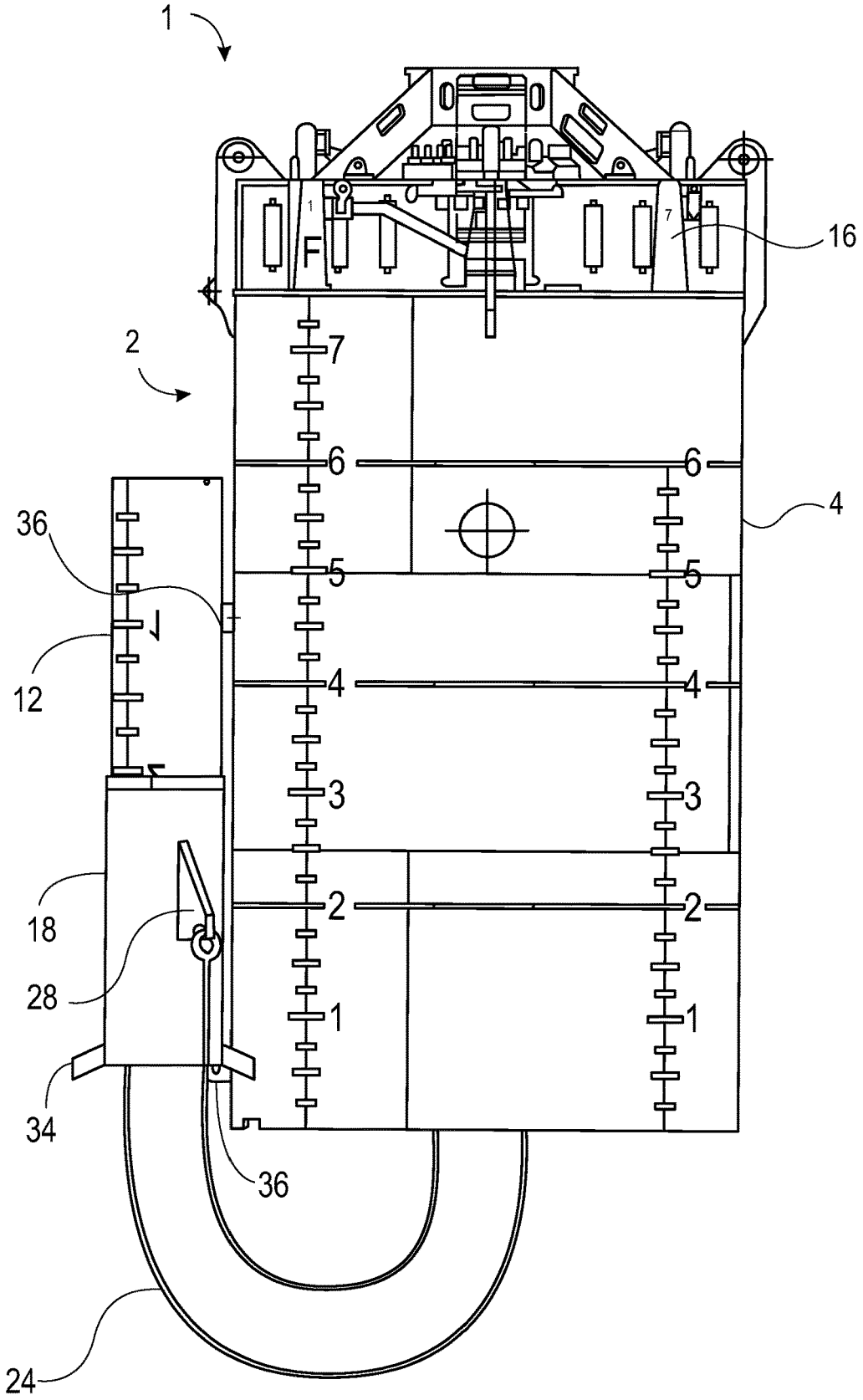
FIG. 4 shows a subsea foundation for deployment.
Figure 5:
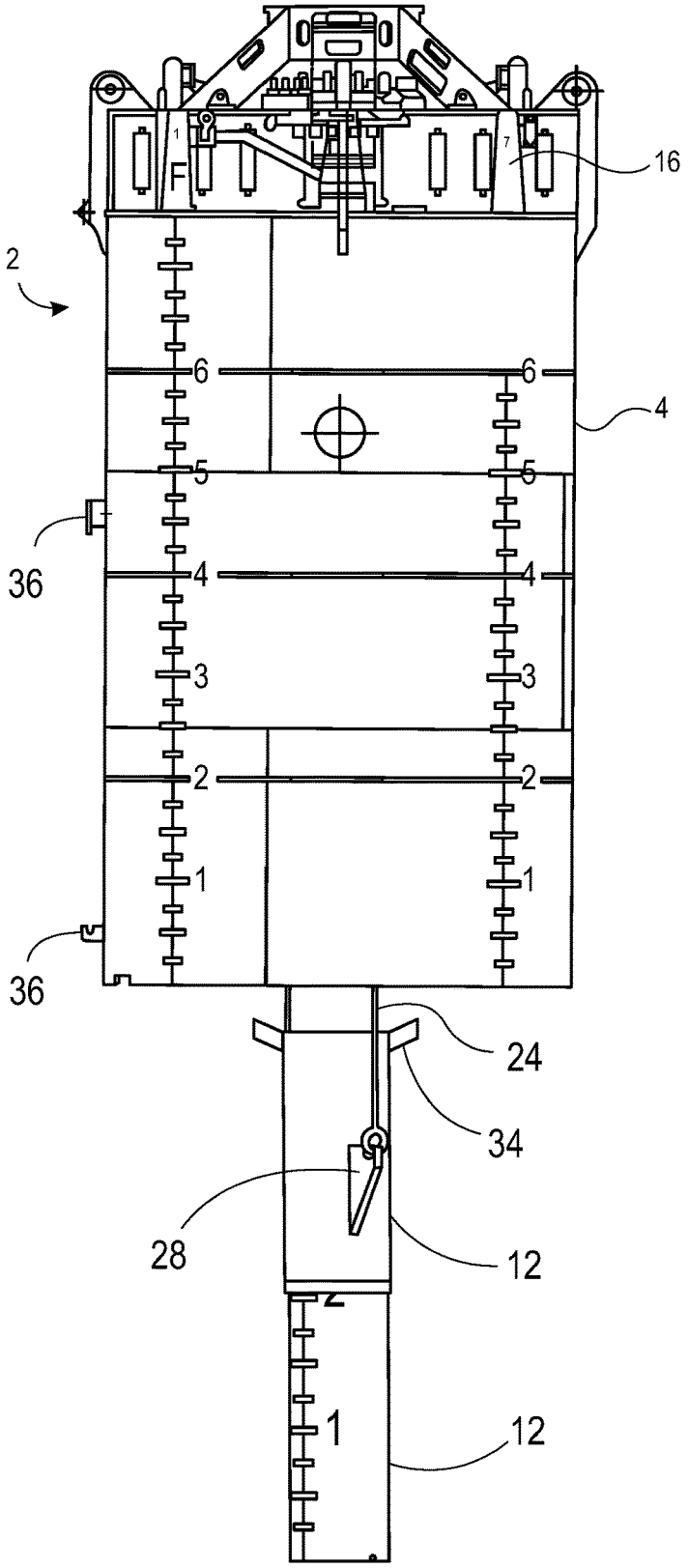
FIG. 5 shows a subsea foundation during deployment.
Figure 6:
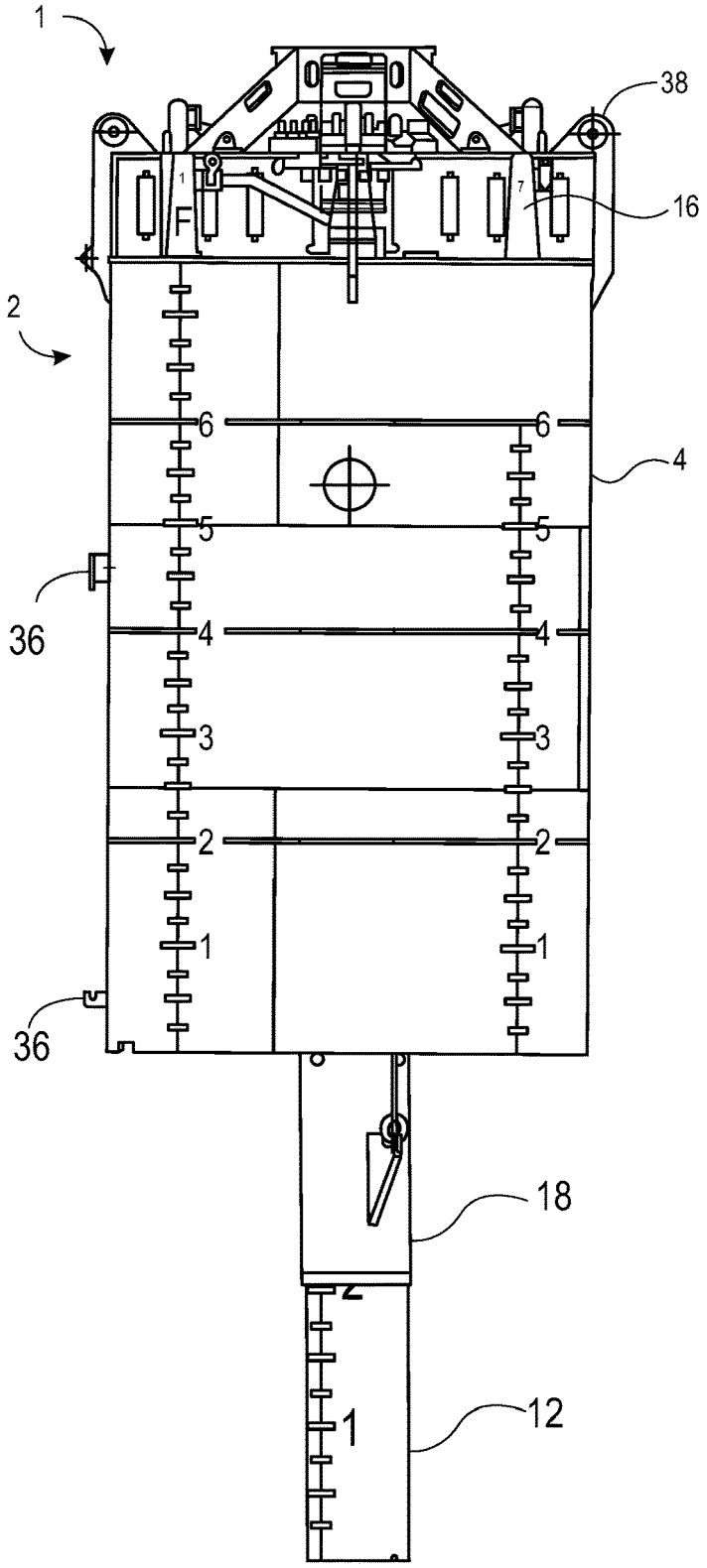
FIG. 6 shows a subsea foundation for installing on a seabed.

FIGS. 4, 5 and 6 illustrate the method of connecting the lower pipe portion 12 to the upper pipe portion 10.

Initially, prior to deployment subsea, the pipe extension (which comprises the pipe overlap section 18 and lower pipe portion 12) is connected to the pull-in arrangement 22. This is achieved by (in any order) connecting each of the pull-in lines 24 at one end to a grip 30, passing the lines 24 each through a respective pull-in line conduit 26 and attaching the other end to the lower pipe portion 12 via the connection wings 28 connected to the pipe overlap section 18 that is connected to the top of the lower pipe portion 12.

Also, prior to deployment subsea, (before, during or after the connection of the pull-in arrangement) the lower pipe portion 12 and overlap pipe section 18 are connected to the outside of the suction anchor 2 in a stowed position as shown in FIG. 4. The lower pipe portion 12 and overlap pipe section 18 when in the stowed position are supported by lugs 36 that are connected to the outside of the skirt 4 of the suction anchor 2. The lower pipe portion 12 and overlap pipe section 18 may be secured to the suction anchor 2 in the stowed position by straps (not shown).

Once the lower pipe portion 12 has been connected to the pull-in arrangement 22 (in this case via the pipe overlap section 18) and connected to the outside of the suction anchor 2 in the stowed position, the subsea foundation 1 may be deployed subsea. For example, the subsea foundation may be held via lifting wires (not shown) connected to pad eyes 38.

Once subsea the lower pipe portion 12 and overlap pipe section 18 may be released from the stowed position such as by cutting the straps (if present). The lower pipe portion 12 and overlap pipe section 18 are allowed to fall into a suspended position below the suction anchor 2 as shown in FIG. 5. The connection between the pull-in arrangement and the lower pipe portion 12 and overlap pipe section 18 holds the lower pipe portion 12 and overlap pipe section 18 in the suspended position.

The lower pipe portion 12 may then be connected to the upper pipe portion 12 by pulling in the pull-in lines through the conduits 26 and grips 30. This pull in may be performed by a winch for example. Once pulled through the suction anchor 2 by a desired amount, excess pull-in line above the grips 30 may be cut off.

As the lower pipe portion 12 is pulled towards the upper pipe portion 10 the pipe connection guide 34 may guide the bottom of the upper pipe portion 10 into the pipe overlap section 18. The upper pipe portion 10 is received in the pipe overlap section 18 until the end of the upper pipe section 10 abuts the end of the lower pipe section 12. In this position the lower pipe portion 12 and pipe overlap section 18 protrude from the bottom of the suction skirt 4 as shown in FIG. 6. The subsea foundation 1 may then be landed onto and sunk into the seabed.

If it is desired to retrieve the suction anchor 2 from the seabed this may be performed in a manner that leaves the lower pipe portion 12 and the pipe overlap section 18 behind in the seabed. Before pumping fluid into the suction anchor 2 to force it out of the seabed, the pull-in lines may be released, either by cutting the lines or releasing the grips 30. As a result (and because there is no other fixing device between the upper pipe portion and lower pipe portion), when the suction anchor 2 is forced out of the seabed, the lower pipe portion 12 and the pipe overlap section 18 are left behind in the seabed.

The invention claimed is:

1. A method of connecting a lower pipe portion to a subsea foundation, the method comprising:
   - providing the subsea foundation, an upper pipe portion being connected to the subsea foundation;
   - connecting the lower pipe portion to a pull-in arrangement and the subsea foundation in a stowed position in which the lower pipe portion is attached to an outside of the subsea foundation and the lower pipe portion does not protrude beyond a bottom of the subsea foundation;
   - deploying the subsea foundation subsea with the lower pipe portion connected to the pull-in arrangement and in the stowed position;
   - releasing the lower pipe portion from the stowed position subsea; and
   - connecting the lower pipe portion to the upper pipe portion using the pull-in arrangement.

2. The method according to claim 1, wherein:
   - the upper pipe portion does not protrude beyond the bottom of the subsea foundation; and
   - when the lower pipe portion is connected to the upper pipe portion, at least part of the lower pipe portion protrudes beyond the bottom of the subsea foundation.

3. The method according to claim 1, further comprising:
   - providing a pipe overlap section,
   - wherein connecting the lower pipe portion to the upper pipe portion comprises
   - overlapping the pipe overlap section on a part of the upper pipe portion or a part of the lower pipe portion.

4. The method according to claim 3, wherein the pipe overlap section is fixed to the lower pipe portion and overlaps the part of the upper pipe portion when the lower pipe portion is connected to the upper pipe portion.

5. The method according to claim 1, wherein the subsea foundation comprises a suction anchor.

6. The method according to claim 1, wherein:
   - the pull-in arrangement comprises two pull-in lines;
   - a first end of each of the two pull-in lines is connected to the subsea foundation; and
   - a second end of each of the two pull-in lines is connected to the lower pipe portion.

7. A subsea foundation system for deployment subsea, the subsea foundation system comprising:
   - a subsea foundation;
   - a pull-in arrangement;
   - an upper pipe portion connected to the subsea foundation; and
   - a lower pipe portion configured to be connected to the pull-in arrangement and the subsea foundation in a stowed position in which the lower pipe portion is attached to an outside of the subsea foundation and the lower pipe portion does not protrude beyond a bottom of the subsea foundation, wherein:

the subsea foundation system is configured such that, subsea, the lower pipe portion can be released from the stowed position and connected to the upper pipe portion using the pull-in arrangement.

8. The subsea foundation system according to claim 7, wherein:

the upper pipe portion does not protrude beyond the bottom of the subsea foundation; and when the lower pipe portion is connected to the upper pipe portion, at least part of the lower pipe portion protrudes beyond the bottom of the subsea foundation.

9. The subsea foundation system according to claim 7, further comprising a pipe overlap section which overlaps a part of the upper pipe portion or a part of the lower pipe portion when the lower pipe portion is connected to the upper pipe portion.

10. The subsea foundation system according to claim 9, wherein the pipe overlap section is fixed to the lower pipe portion and overlaps the part of the upper pipe portion when the lower pipe portion is connected to the upper pipe portion.

11. The subsea foundation system according to claim 7, further comprising a pipe connection guide for guiding a connection between the upper pipe portion and lower pipe portion.

12. The subsea foundation system according to claim 7, wherein the subsea foundation comprises a suction anchor.

13. The subsea foundation system according to claim 7, wherein:

the pull-in arrangement comprises two pull-in lines;

a first end of each of the two pull-in lines is connected to the subsea foundation; and a second end of each of the two pull-in lines is connected to the lower pipe portion.

* * * * *